US006915929B2

(12) United States Patent
Rauch et al.

(10) Patent No.: US 6,915,929 B2
(45) Date of Patent: Jul. 12, 2005

(54) FOLDING APPARATUS FOR FOLDING PIECES OF LINEN

(75) Inventors: Martin Rauch, Hasle-Rueeggsau (CH); Jorn Munch Jensen, London (GB)

(73) Assignee: Jensen AG Burgdorf, Burgdorf (CH)

( * ) Notice: Subject to any disclaimer, the term of this patent is extended or adjusted under 35 U.S.C. 154(b) by 0 days.

(21) Appl. No.: 10/246,631

(22) Filed: Sep. 19, 2002

(65) Prior Publication Data

US 2003/0052141 A1 Mar. 20, 2003

(30) Foreign Application Priority Data

Sep. 20, 2001 (EP) ..... 01810912

(51) Int. Cl.[7] ..... A41H 33/00
(52) U.S. Cl. ..... 223/37; 493/937
(58) Field of Search ..... 223/37; 270/41; 493/441, 937, 12, 16

(56) References Cited

U.S. PATENT DOCUMENTS

| | | | | |
|---|---|---|---|---|
| 4,898,373 A | | 2/1990 | Newsome | |
| 5,540,647 A | * | 7/1996 | Weiermann et al. | 493/444 |
| 6,241,232 B1 | | 6/2001 | Schmitt et al. | |

FOREIGN PATENT DOCUMENTS

| | | |
|---|---|---|
| EP | 0 612 879 A1 | 8/1994 |
| JP | 62-191375 | 8/1987 |
| JP | 2000-238960 | 9/2000 |

* cited by examiner

*Primary Examiner*—John J. Calvert
*Assistant Examiner*—James G Smith
(74) *Attorney, Agent, or Firm*—Oblon, Spivak, McClelland, Maier & Neustadt, P.C.

(57) ABSTRACT

A first belt conveyor (5) and a second belt conveyor (8) form a first transverse folding station (4) having a folding channel (16) formed between folding sides (14; 15) of the belt conveyors (5; 8). If a fault occurs in said folding channel by virtue of the fact that a piece of linen (39) bunches together into a coil and cannot be transported further, this is detected by means of a delivery sensor (38), the belt conveyors (5, 8) are stopped and the second belt conveyor (8) is pivoted outwards about a pivot axle (12) so that the width of the folding channel (16) at its upper end can be increased to at least 80 mm and the piece of linen can be readily removed. Arranged below the folding channel (16) is a third belt conveyor (23) having a folding section (29) which slopes sharply downwards for receiving a piece of linen and belongs to an upper support side (28) which can be pivoted upwards before a second fold carried out with reversal of the direction of movement of the third belt conveyor (23).

21 Claims, 6 Drawing Sheets

FOLDING APPARATUS FOR FOLDING PIECES OF LINEN

FIELD OF THE INVENTION

The invention relates to a folding apparatus according to the precharacterizing clause of claim 1. Such folding apparatuses are used in particular in laundries for folding pieces of linen.

DESCRIPTION OF THE PRIOR ART

In folding apparatuses of the generic type, it frequently occurs that the piece of linen to be folded becomes bunched up in the folding channel and can no longer leave the latter. This causes a fault, in particular blocking of the folding apparatus, which can be eliminated only by shutting down of the belt conveyor and subsequent manual intervention.

In a folding apparatus of the generic type which is sold by the Applicant under the name TEMATIC Plus and in which the width of the folding channel, similarly to that described in EP-B-0 612 879, is adjustable between about 15 mm and 50 mm in the operating state to adapt to the thickness of the piece of linen, the belt conveyors automatically stop when a fault occurs and the width of the folding channel is adjusted to the maximum of 50 mm. Nevertheless, elimination of the fault is often very tedious and in some cases requires partial dismantling. Prolonged interruption of the work, which can also effect upstream and downstream devices, is then unavoidable.

SUMMARY OF THE INVENTION

It is the object of the invention to provide a folding apparatus of the generic type, in which faults of the above-mentioned type can be easily and rapidly eliminated. This object is achieved by the features in the characterizing clause of claim 1. The folding apparatus according to the invention permits rapid elimination of such faults by permitting in each case simple removal of the piece of linen by manual intervention.

BRIEF DESCRIPTION OF THE DRAWINGS

The invention is explained in more detail below with reference to figures, which show only one embodiment.

DESCRIPTION OF THE PREFERRED EMBODIMENTS

Figure 1:
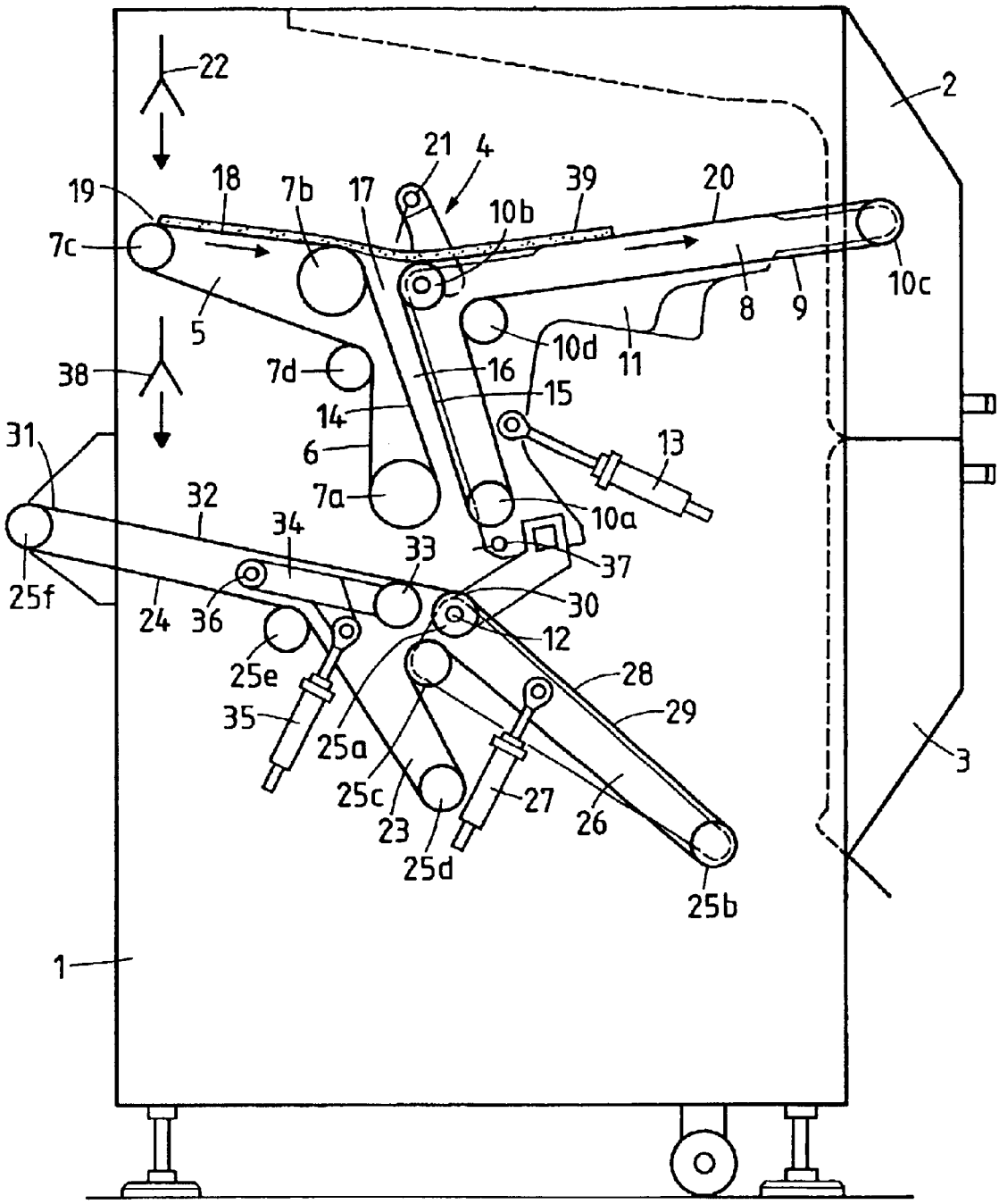
FIG. 1 schematically shows the side view of a folding apparatus according to the invention during a first phase of a folding process.

The folding apparatus has (FIG. 1) an approximately right parallelepiped housing 1 whose front-facing wall has been omitted in the figures. The housing 1 comprises two flaps 2, 3 which can be opened, whereupon the interior of the housing is accessible. A first transverse folding station 4 arranged in the upper part of the housing 1 comprises a first belt conveyor 5 having a plurality of parallel closed belts 6 which are side by side and a distance apart and which are transported by means of pulleys 7*a–d* rotatably mounted in the housing and having parallel axles, one of which pulleys is drivable. Arranged at the same height in the housing 1 is a second belt conveyor 8 which likewise has parallel closed belts 9 which are side by side and a distance apart and which are transported by means of pulleys 10*a–d* having axles parallel to those of the pulleys 7*a–d* of the first belt conveyor 5. The pulleys 10*a–d* are mounted in a holder 11 which is mounted in the housing 1 so as to be pivotable about a pivot axle 12 parallel to the pulley axles, by means of a switching device in the form of a pneumatic piston 13. One of the pulleys 10*a–d* is drivable.

The first belt conveyor 5 has a first folding side 14 which lies between the pulleys 7*a* and 7*b* and, together with a second folding side 15 lying between the pulleys 10*a* and 10*b* and belonging to the second belt conveyor 8, which is parallel to and a distance away from the first folding side 14 in the operating state shown in FIG. 1, forms a steeply declining folding channel 16 having, at its upper end, a draw-in gap 17 lying between the pulleys 7*b* and 10*b*. Arranged before the first folding side 14 is a first support side 18 of the first belt conveyor 5, which support side lies between the pulleys 7*b* and 7*c* and connects a feed point 19 to the draw-in gap 17. Located at about the same height is a second support side 20 of the second belt conveyor 8, which support side is arranged before the second folding side 15 and lies between the pulleys 10*b* and 10*c*. The first support side 18 and the second support side 20 thus form an approximately horizontal support surface which is interrupted by the draw-in gap 17 but falls away slightly on both sides relative to the draw-in gap 17.

The pivot axle 12 of the holder 11 is arranged slightly below the lower end of the folding channel 16. Mounted above the draw-in gap 17 is an air lance 21 which can produce compressed air pulses directed towards said gap. A feed sensor 22 in the form of a photocell is arranged in the region of the feed point 19, above the first support side 18.

Arranged below the first belt conveyor 5 and the second belt conveyor 8 is a third belt conveyor 23, once again having a plurality of parallel belts 24 which are side by side and a distance apart and which run over pulleys 25*a–f* whose axles are parallel to those of the pulleys 7*a–d* and 10*a–d* and of which once again one is drivable. The pulley 25*b* is mounted in a holder 26 which is pivotable, by means of an adjusting device in the form of a pneumatic piston 27, like the holder 11, about the pivot axle 12, with which the axle of the pulley 25*a* also coincides. The third belt conveyor 23 comprises a third support side 28 which is located at the top and consists of a folding section 29 and a conveying section 32. The latter extends from a transition point 30 which lies slightly below the exit of the folding channel 16 and to which the third support side 28 runs via the pulley 25*a*, in the conveying direction, to a delivery point 31, while the former extends from the transition point 30, in a direction opposite to the conveying direction, to the end of the third support side 28.

Below the third support side 28, a lifting roller 33 is arranged below the pulley 7*a*, i.e. opposite the transition point 30, slightly offset towards the delivery point 31. Said lifting roller is mounted in a further holder 34 which is pivotable, by means of a lifting device in the form of a pneumatic piston 35, about a pivot axle 36 arranged below the third support side 28 and further offset relative to the delivery point 31. An air lance 37 arranged slightly below the pulley 10*a* is directed towards the gap lying between the third support side 28 and the pulley 7*a*. As will become clearer later on, the third belt conveyor 23, together with the lower end of the first folding side 14, forms a second transverse folding station. Before the delivery point 31, a delivery sensor 38 in the form of a photocell is arranged above the third support side 28.

The folding apparatus furthermore contains a control device (not shown) which preferably comprises a microprocessor and to which the response signals of the feed sensor 22 and of the delivery sensor 38 and signals of any further sensors are fed and which controls the movements of the belt conveyors 5, 8 and 23 and of the pneumatic pistons 13, 27, 35 on the basis of these and possibly other signals and inputs by operators.

In the operating state of the folding apparatus, pieces of linen are transported through the folding apparatus in a conveying direction from the feed point 19 through the folding channel 16 to the delivery point 31 and are folded twice during this procedure. A piece of linen 39, for example a bed sheet or a hand towel, for example arriving from a mangle, thus reaches (FIG. 1) the feed point 19, where it is passed onto the first support side 18 and at the same time its front edge is detected by the feed sensor 22, which starts a counter in the control device. The first belt conveyor 5 and the second belt conveyor 8 run parallel, as indicated in FIG. 1 by arrows, until the piece of linen 39 has reached the position shown there, which is symmetrical with respect to the draw-in gap 17, on the support surface formed by the first support side 18 and by the second support side 20. At this instant, the direction of movement of the second belt conveyor 8 is reversed and at the same time the air lance 21 is activated so that (FIG. 2) the piece of linen 39 is drawn through the draw-in gap 17 into the folding channel 16 with transverse folding about its centre line.

Figure 2:
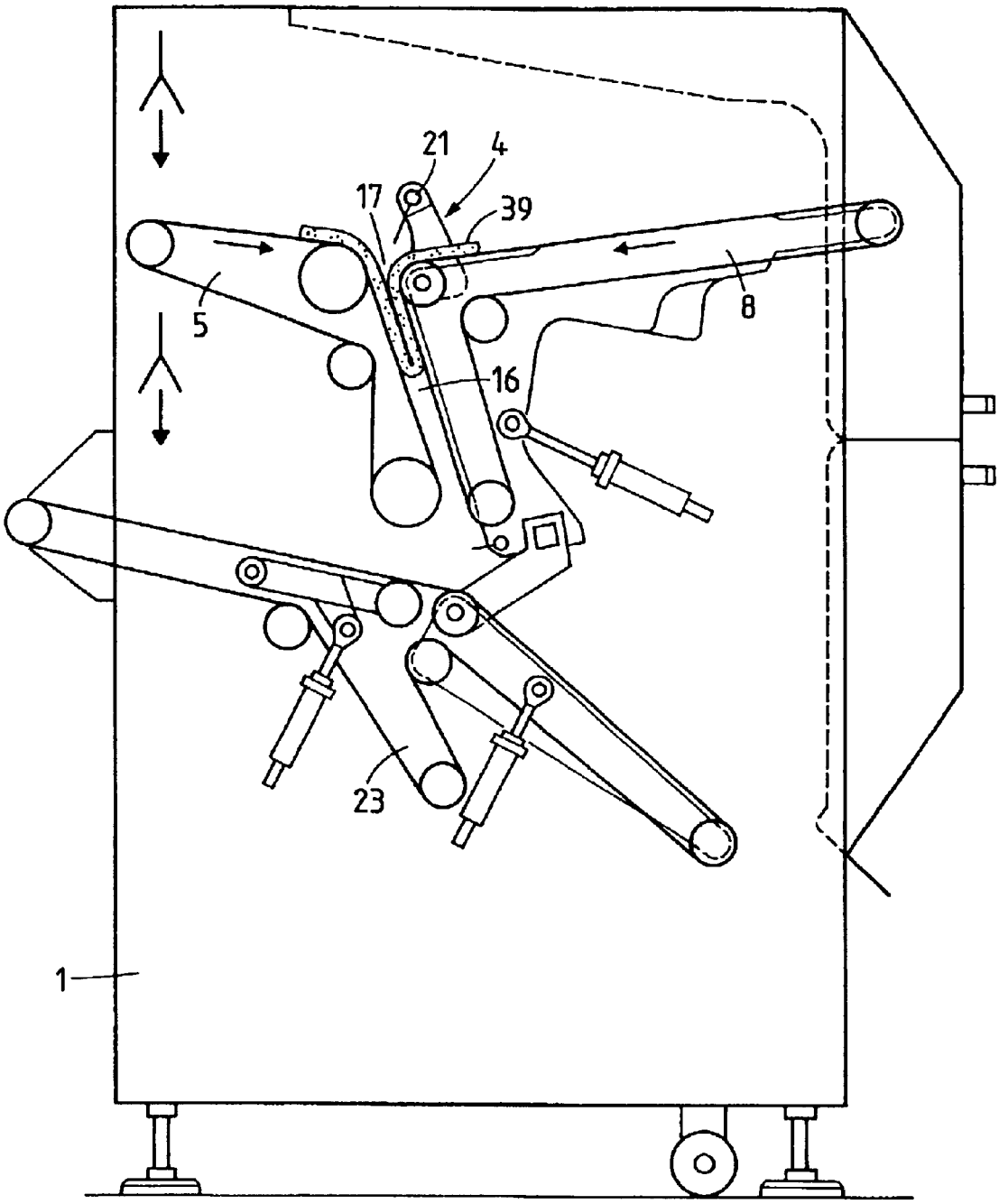
FIG. 2 shows a side view corresponding to FIG. 1, during a second phase of the folding process.
Figure 3:
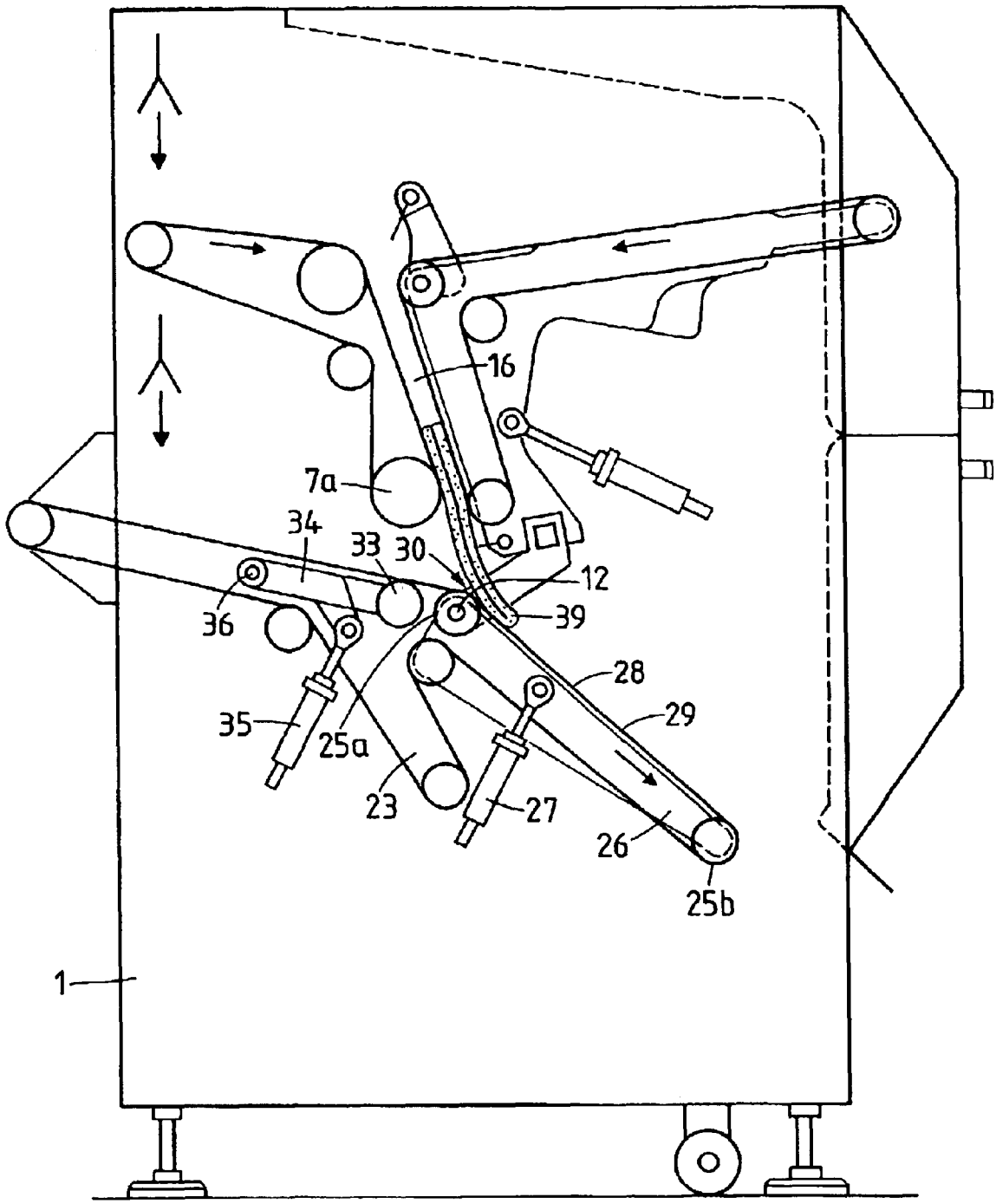
FIG. 3 shows a side view corresponding to FIG. 1, during a third phase of the folding process.

Furthermore, the piece of linen 39 folded once runs (FIG. 3) out of the lower end of the folding channel 16. Its front edge comes into contact, just next to the transition point 30, with the folding section 29 of the third support side 28, which moves in the direction of the arrow. In that receiving state of the third conveyor belt 23 which is shown in FIG. 1-3, the holder 26 is in a position in which the pulley 25*b* and hence that end of the folding section 29 which is opposite the transition point 30 are lowered so that the latter slopes down sharply and makes a very obtuse receiving angle with the folding channel 16. Consequently, the front edge of the piece of linen 39 runs without problems onto the third support side 28 and faults, such as twisting or folding over of the front edge, are avoided.

Figure 4:
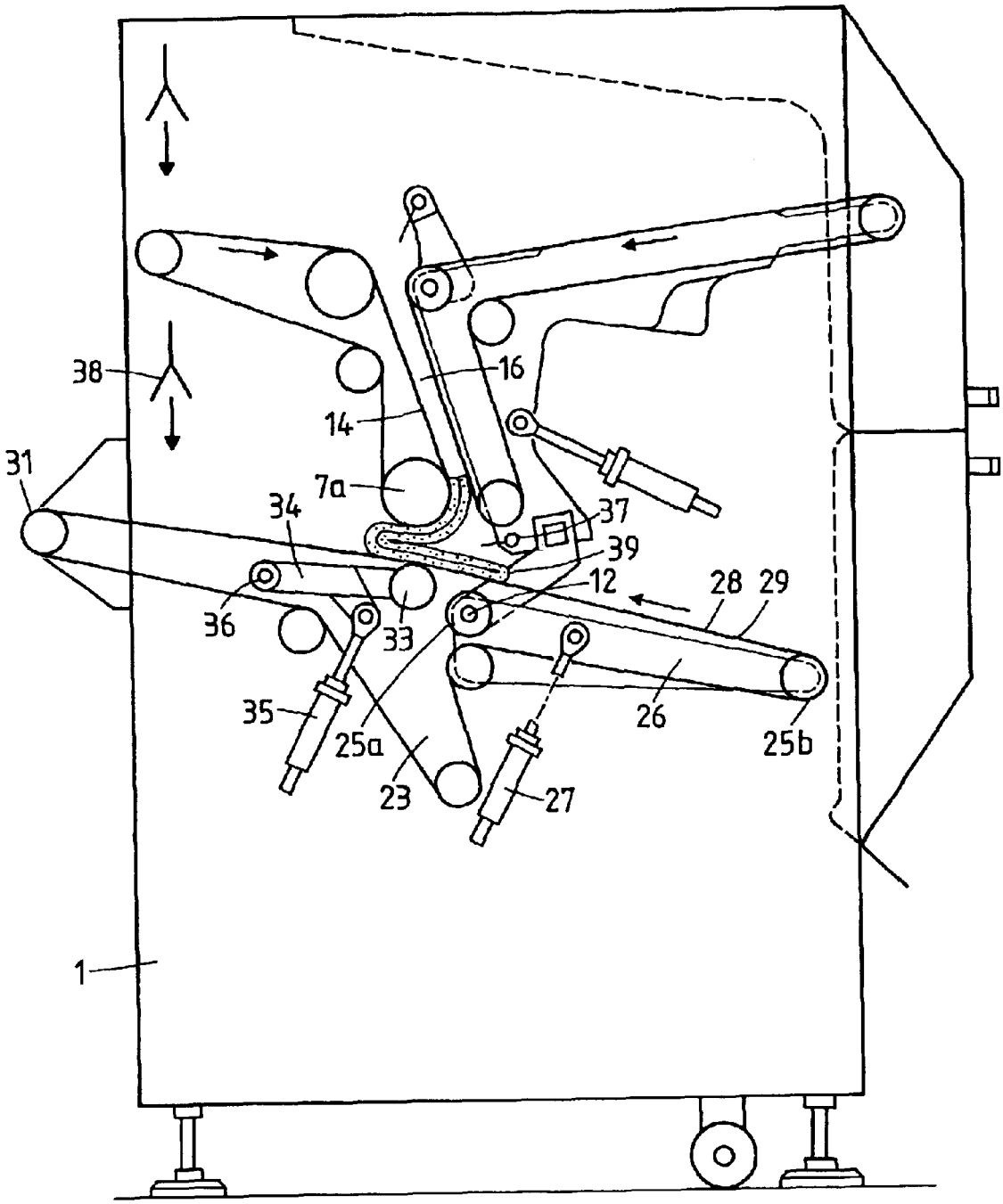
FIG. 4 shows a side view corresponding to FIG. 1, during a fourth phase of the folding process.

Once the piece of linen 39 has reached the position shown in FIG. 3, the third belt conveyor 23 is brought from the receiving state into a folding state. For this purpose, the holder 26 is rotated by means of the pneumatic cylinder 27 about the pivot axis 12 in such a way that the end carrying the pulley 25*b* is raised (FIG. 4). At the same time, the holder 34 is rotated about the pivot axle 36 by means of the pneumatic piston 35 in such a way that the lifting roller 33 is raised from a rest position to a position of use in which it in turn raises the support side 28 and lifts it off the pulley 25*a*. A relatively narrow gap is then formed at the point where it runs over the lifting roller 33, with the lower end of the first folding side 14, which runs there over the pulley 7*a*. Nevertheless, the folding section 29 now makes with the folding channel 16 a folding angle which is still an obtuse angle but is substantially smaller than the receiving angle.

Figure 5:
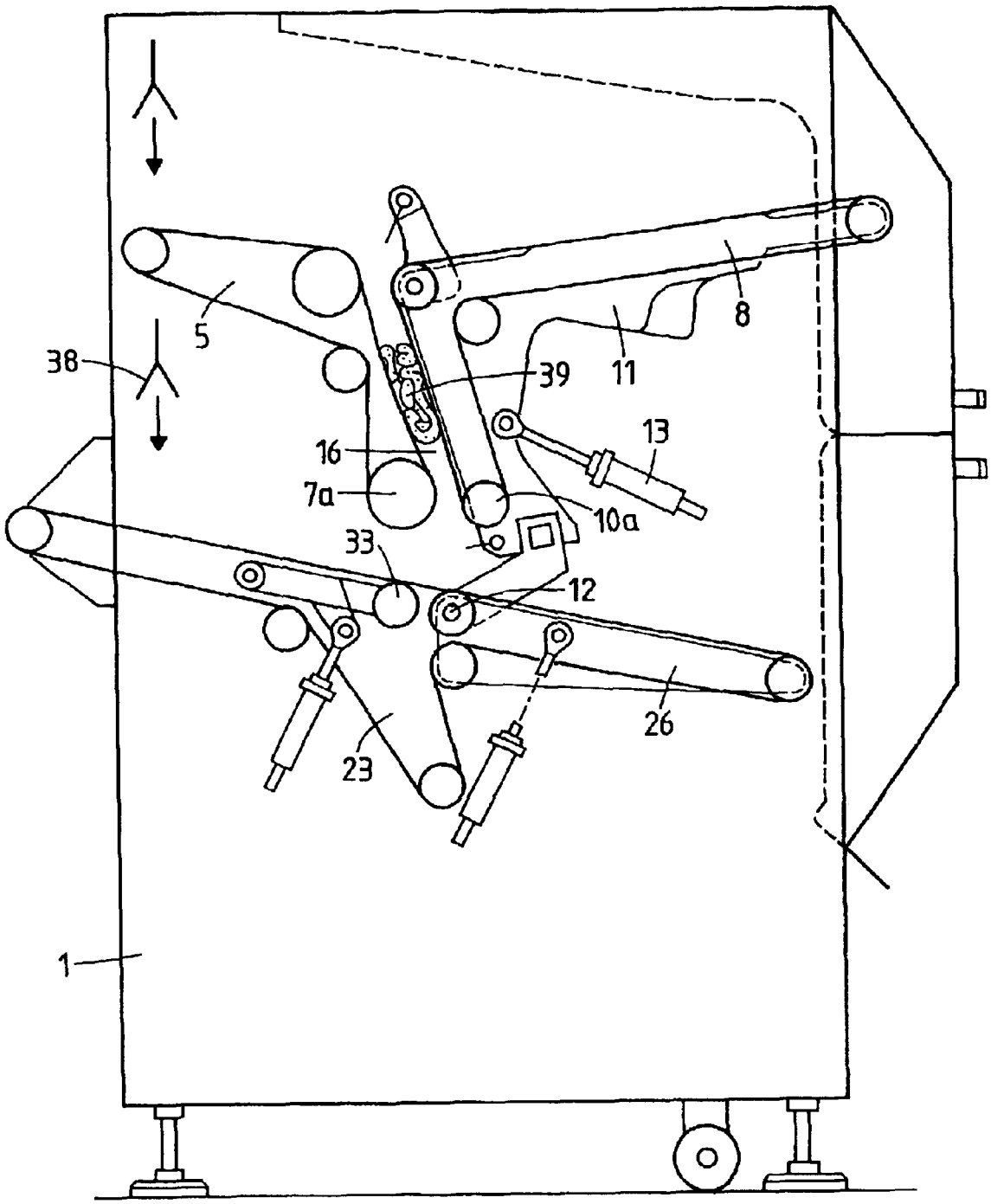
FIG. 5 shows a side view corresponding to FIG. 1, during a fault which has occurred during the second phase of the folding process.

After this switching to the folding state, the direction of movement of the third belt conveyor 23 is reversed (cf. arrow in FIG. 4) and the air lance 37 is activated and in this way the piece of linen 39 is subjected to a second transverse folding about the centre line of the piece of linen 39 which has been folded once. This folding is facilitated by the flatter path of the third support side 28 in the folding state of the third belt conveyor 23. The piece of linen 39 is then transported on the third support side 28 to the delivery point 31. Switching of the third belt conveyor 23 between the receiving state and the folding state is not necessary in every case. In many cases, it may also remain permanently in the folding state or, except for during the second transverse folding, may assume a state in which the holder 26 is swivelled up but the lifting roller 33 is not raised, as indicated in FIG. 5.

Shortly before the piece of linen 39 reaches the delivery point 31, its front edge is detected by the delivery sensor 38. Since no fault has occurred, this detection is within a monitoring interval, as can be determined by comparison of the counter reading in the control device with comparison values, and no fault is found by the control device, so that the folding apparatus remains in the operating state. The monitoring interval may begin, for example, with the detection of the front edge by the feed sensor 22 and last for a time span which is longer by a safety margin than the expected throughput time to the delivery sensor 38. The time span may be a fixed value or may depend on other measured or input quantities which reflect, for example, the length of the piece of linen and the type of folding.

Figure 6:
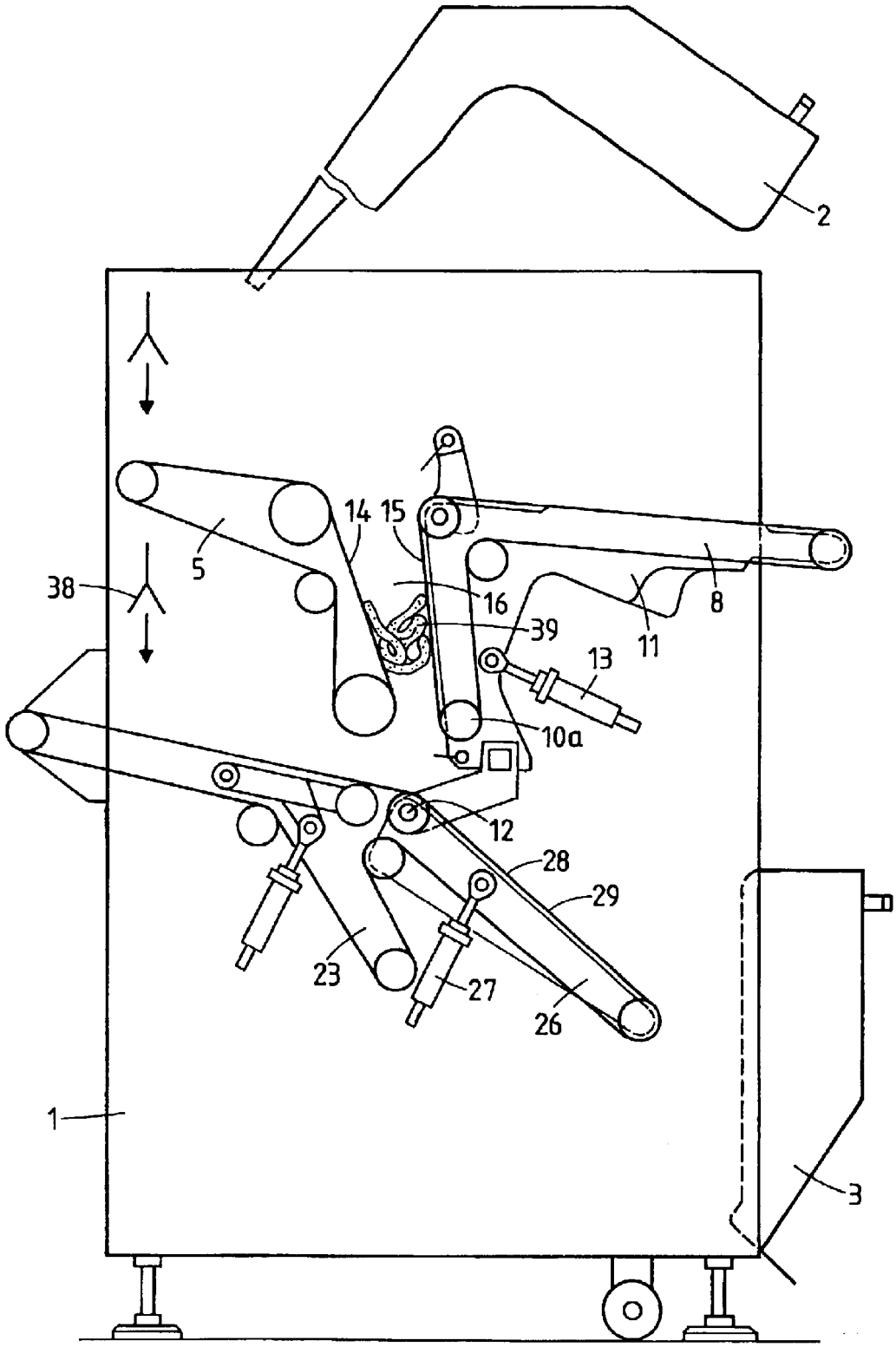
FIG. 6 shows a side view corresponding to FIG. 1, during a fault elimination state of the folding apparatus according to the invention.

If, on the other hand (FIG. 5), a fault occurs during passage through the folding channel 16 in that the piece of linen 39 becomes bunched up into a coil there so that it cannot pass between the pulleys 7*a* and 10*a*, it does not reach the delivery sensor 38 within the monitoring interval. In this case, the control device detects a fault and switches the folding apparatus from the operating state to a fault elimination state. For this purpose, the belt conveyors 5, 8 and 23 are stopped and (FIG. 6) the holder 11 is tilted away from the first belt conveyor 5 by means of the pneumatic cylinder 13 so that the width of the folding channel 16 itself is increased at its lower end to about 60 mm, whereas it corresponds at its upper end to a generously dimensioned fault elimination width of about 115 mm. If it is in the raised position shown in FIG. 5, the holder 26 is swivelled downwards by means of the pneumatic piston 27 into a position which corresponds to that which it assumes in the receiving state of the third belt conveyor 23. The folding section 29 thereby assumes a fault elimination position in which its distance from the pulley 10*a* of the second belt conveyor 8 is relatively large. The piece of linen 39 can therefore easily be manually removed after opening the flap 2, and this can preferably be effected in an upward direction where access is particularly simple owing to the very large width of the folding channel 16 there. However, even the smaller width of the folding channel 16 at its lower end generally also permits the removal of the piece of linen in a downward direction.

Numerous modifications of the apparatus described are of course possible without departing from the concept of the invention. Thus, a fault elimination width of 80 mm assumed at one end or over the total length of the folding channel is as a rule sufficient since it already permits the introduction of a hand. Even a fault elimination width of 80 mm at the upper end of the folding channel and a width of 50 mm at its lower end generally permit the removal of the piece of linen from above or from below, especially since at least a part thereof is usually present close to the lower end. Removal is more convenient in the case of a fault elimination width of 100 mm or more at the upper end and 60 mm width at the lower end. The feed sensor and the delivery sensor may be formed differently, for example as mechanical sensors.

It is also possible to use a completely differently formed sensor device for detecting faults, for example one which detects an increase in the forces which are required for driving the first belt conveyor and the second belt conveyor or in the forces which act laterally on the bearings of the pulleys between which the folding sides of said belt conveyors lie. It is also possible to provide an optical sensor directly at the end of the folding channel, in which case the belt conveyors can be stopped even more rapidly.

The folding apparatus can also be formed in such a way that the signal of the fault sensor immediately causes only stopping of the belt conveyors and, for example, the production of a fault signal, whereas switching over to the fault elimination state with an increase in the width of the folding channel to the fault elimination width takes place only when a switch is subsequently pressed by an operator.

As is the case in some of the prior art, the width of the folding channel may also be adjustable within certain limits, for example between 15 mm and 50 mm, in the operating state to adapt to the thickness of the piece of linen to be folded. The set width is then at least approximately constant in each case over the total length of the folding channel.

The possibility of switching the third belt conveyor between a receiving state and a folding state or an intermediate state facilitates fault elimination but is not absolutely essential for this. Conversely, the improvement in the folding in the second transverse folding station, which is permitted by the switching, is independent of the possibility of switching the width of the folding channel from the operating width to the larger fault elimination width, which possibility is decisive for fault elimination.

| List of reference symbols | |
|---|---|
| 1 | Housing |
| 2,3 | Flaps |
| 4 | Transverse folding station |
| 5 | First belt conveyor |
| 6 | Belt |
| 7a–d | Pulleys |
| 8 | Second belt conveyor |
| 9 | Belt |
| 10a–d | Pulleys |
| 11 | Holder |
| 12 | Pivot axle |
| 13 | Pneumatic piston |
| 14 | First holding side |
| 15 | Second holding side |
| 16 | Folding channel |
| 17 | Draw-in cap |
| 18 | First support side |
| 19 | Feed point |
| 20 | Second support side |
| 21 | Air lance |
| 22 | Feed sensor |
| 23 | Third conveyor belt |
| 24 | Belt |
| 25a–f | Pulleys |
| 26 | Holder |
| 27 | Pneumatic piston |
| 28 | Third support side |
| 29 | Folding section |
| 30 | Transfer point |

-continued

| List of reference symbols | |
|---|---|
| 31 | Delivery point |
| 32 | Conveying section |
| 33 | Lifting roller |
| 34 | Holder |
| 35 | Pneumatic piston |
| 36 | Pivot axle |
| 37 | Air lance |
| 38 | Delivery sensor |
| 39 | Piece of linen |

What is claimed is:

1. Folding apparatus, comprising:

a first folding station comprising:

a first conveyor comprising a first belt surrounding a first plurality of pulleys; and a second conveyor, wherein the first and second conveyors define a channel configured to fold a linen therebetween, and wherein one end of at least one of the first and second conveyors is configured to be moved to increase a width of a portion of the channel to at least 80 mm in a fault elimination state.

2. Folding apparatus according to claim 1, wherein the width of the portion of the channel is at least 100 mm the fault elimination state.

3. Folding apparatus according to claim 1, wherein the width of the portion of the channel in the fault elimination state is greater than widths over the entire length of the channel in an operating state.

4. Folding apparatus according to claim 1, wherein a minimum width over an entire length of the channel is at least 50 mm in the fault elimination state.

5. Folding apparatus according to claim 1, wherein the second conveyor is connected to a holder configured to be pivoted by a switching device.

6. Folding apparatus according to claim 5, wherein a pivot axle of the holder is arranged parallel to the axles of the first plurality of pulleys in a continuation of the channel.

7. Folding apparatus according to claim 1, wherein the channel slopes downwards in a conveying direction of the apparatus.

8. Folding apparatus according to claim 1, wherein the channel slopes downwards in a conveying direction of the apparatus, and portions of the first conveyor and the second conveyor form an approximately flat support surface.

9. Folding apparatus comprising:

a first folding station comprising:

a first conveyor comprising a first belt surrounding a first plurality of pulleys; and a second conveyor, wherein the first and second conveyors define a channel configured to fold a linen therebetween, and one end of at least one of the first and second conveyors is configured to be moved to increase a width of a portion of the channel to at least 80 mm in a fault elimination state; and a sensor configured to detect a fault during transport of the linen through the channel.

10. Folding apparatus according to claim 9, wherein the sensor comprises a feed sensor and a delivery sensor disposed on an opposite side of the channel from the feed sensor.

11. Folding apparatus according to claim 1, further comprising:

a second folding station comprising:

a third conveyor disposed below the channel configured to receive the folded linen from the channel.

12. Folding apparatus according to claim 11, wherein the third conveyor is configured to be disposed in a receiving state and a folding state, the receiving state configured to form a first angle between a second portion of the third conveyor and the channel to receive the folded linen from the channel, and the folding state configured to form a second angle between the second portion of the third conveyor and the channel to further fold the folded linen, wherein the first angle is larger than the second angle.

13. Folding apparatus according to claim 12, wherein the third conveyor comprises a folding section configured to further fold the folded linen and a conveying section configured to convey the folded linen from the channel.

14. Folding apparatus according to claim 13, wherein the third conveyor comprises a lifting roller configured to be disposed in a rest position when the third conveyor is disposed in the receiving state, and to be disposed in a raised position when the third conveyor is disposed in the folding state.

15. Folding apparatus according to claim 13, wherein the folding section is configured to form a greater angle with the channel in the fault elimination state than in the folding state.

16. Folding apparatus according to claim 15, wherein the folding section is configured to form an angle with the channel in the fault elimination position that is at least as large as an angle between the folding section and the channel in the receiving state.

17. Folding apparatus according to claim 1, wherein the minimum width over the entire length of the channel is at least 60 mm in the fault elimination state.

18. Folding apparatus comprising:

a first folding station comprising:

a first conveyor comprising a first belt surrounding a first plurality of pulleys; and a second conveyor, wherein the first and second conveyors define a channel configured to fold a linen therebetween, and one end of at least one of the first and second conveyors is configured to be moved to increase a width of a portion of the channel to at least 80 mm in a fault elimination state;

a sensor configured to detect a fault during transport of the linen through the channel; and a control device configured to initiate the fault elimination state based on an output of the sensor.

19. Folding apparatus according to claim 1, wherein the second conveyor comprises a second belt surrounding a second plurality of pulleys.

20. Folding apparatus according to claim 13, wherein the folding section is configured to form a greater angle with the channel in the receiving state than in the folding state.

21. Folding apparatus, comprising:

a first folding station comprising:

a first conveyor comprising a first belt surrounding a first plurality of pulleys; and a second conveyor, the first and second conveyors define a channel configured to fold a linen therebetween, and one end of at least one of the first and second conveyors is configured to be moved to increase a width of a portion of the channel in a fault elimination state; and a sensor configured to detect a fault during transport of the linen through the channel.

* * * * *